United States Patent [19]

Frame

[11] 4,127,474

[45] Nov. 28, 1978

[54] TREATING A PETROLEUM DISTILLATE WITH AN ALKANOLAMINE HYDROXIDE AND A SUPPORTED OXIDATION CATALYST IMPREGNATED WITH POLYNUCLEAR AROMATIC SULFONIC ACID

[75] Inventor: Robert R. Frame, Glenview, Ill.

[73] Assignee: UOP Inc., Des Plaines, Ill.

[21] Appl. No.: 882,844

[22] Filed: Mar. 2, 1978

Related U.S. Application Data

[63] Continuation-in-part of Ser. No. 756,578, Jan. 3, 1977.

[51] Int. Cl.[2] ..... C10G 27/06

[52] U.S. Cl. ..... 208/207

[58] Field of Search ..... 208/206, 207; 252/428, 252/431 N

[56] References Cited

U.S. PATENT DOCUMENTS

| | | | |
|---|---|---|---|
| 2,616,831 | 11/1952 | Rosenwald | 208/206 |
| 2,891,002 | 6/1959 | Bowers | 208/206 |
| 2,978,404 | 4/1961 | Bowers | 208/207 |
| 3,144,403 | 8/1964 | Jacob | 208/206 |
| 4,033,860 | 7/1977 | Carlson | 208/207 |

*Primary Examiner*—George Crasanakis

*Attorney, Agent, or Firm*—James R. Hoatson, Jr.; Robert W. Welch; William H. Page, II

[57] ABSTRACT

A process for treating a mercaptan-containing sour petroleum distillate is disclosed. The process comprises contacting the distillate with a supported mercaptan oxidation catalyst impregnated with a polynuclear aromatic sulfonic acid, said contacting being at oxidation conditions in the presence of an alkanolamine hydroxide.

14 Claims, 1 Drawing Figure

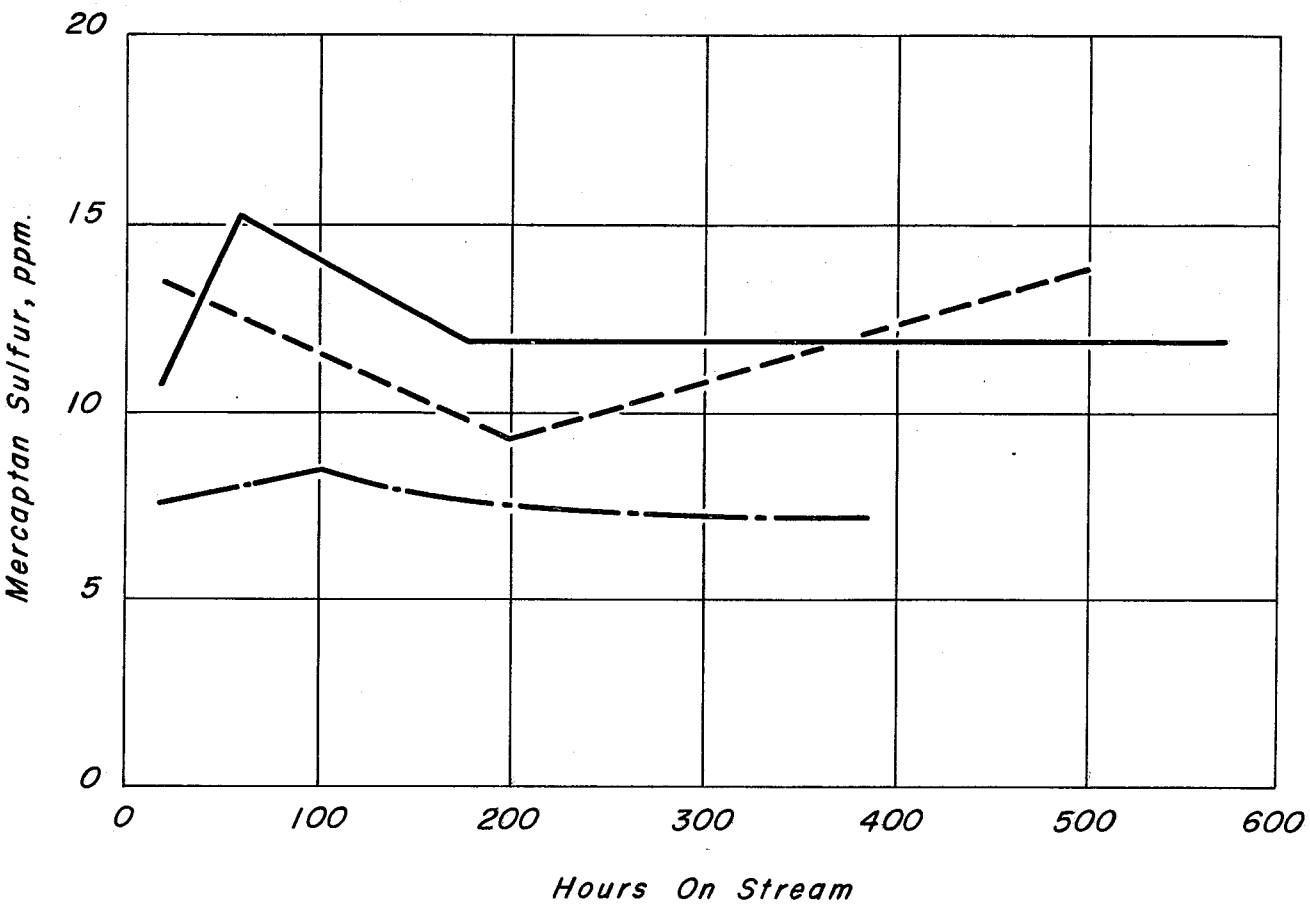
Mercaptan Sulfur, ppm.
20
15
10
5
0
0
100
200
300
400
500
600
Hours On Stream

TREATING A PETROLEUM DISTILLATE WITH AN ALKANOLAMINE HYDROXIDE AND A SUPPORTED OXIDATION CATALYST IMPREGNATED WITH POLYNUCLEAR AROMATIC SULFONIC ACID

CROSS-REFERENCE TO RELATED APPLICATIONS

This application is a continuation-in-part of a copending application Ser. No. 756,578 filed Jan. 3, 1977.

Process for treating sour petroleum distillates wherein the distillate is contacted with a supported mercaptan oxidation catalyst at oxidation conditions in the presence of an alkaline reagent have become well-known and widely practiced in the petroleum refining industry. One such process is described in U.S. Pat. No. 2,988,500. The process is typically designed to effect the catalytic oxidation of the offensive mercaptans contained in a sour petroleum distillate with the formation of innocuous disulfides—a process commonly referred to as sweetening. The oxidizing agent is most often air admixed with the sour petroleum distillate to be treated, and the alkaline reagent is most often sodium hydroxide in aqueous solution, the aqueous caustic solution being charged continuously to the process, or intermittently as required.

The sour petroleum distillates vary widely with respect to the concentration as well as the complexity of the mercaptans contained therein. In general, the lower boiling petroleum distillates, including the natural, straight-run and cracked gasolines, contain the lower molecular weight, less complex mercaptans, and are more readily treated in the sweetening process. The higher boiling petroleum distillates, e.g., kerosene, fuel oil, jet fuel, naphtha and the like, boiling in excess of about 135° C., contain the more complex, difficulty oxidizable mercaptans, i.e., the highly hindered branched chain and aromatic thiols, especially the higher molecular weight tertiary and the polyfunctional mercaptans. These higher boiling distillates will invariably further comprise one or more catalyst deactivating agents, frequently referred to as catalyst toxins. These toxins are usually phenolic materials and higher molecular weight aliphatic, naphthenic and condensed ring aromatic acids which deposit and accumulate on the catalyst to promote catalyst activity instability and premature deactivation.

It is an object of this invention to present a process effecting improved oxidation of mercaptans contained in a sour petroleum distillate, particularly the more difficulty oxidizable mercaptans, in contact with a supported catalyst of improved activity stability.

In one of its broad aspects, the present invention embodies a process which comprises contacting a mercaptan-containing sour petroleum distillate with a supported mercaptan oxidation catalyst impregnated with from about 0.1 to about 25 wt. % polynuclear aromatic sulfonic acid, said contacting being at oxidation conditions in the presence of an alkanolamine hydroxide represented by the structural formula

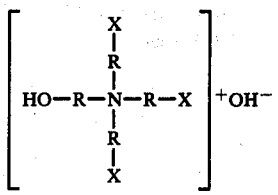

wherein R is an alkylene radical containing up to about 3 carbon atoms, and X is a hydroxyl radical or hydrogen.

One of the more specific embodiments relates to a process which comprises contacting said distillate with a charcoal-supported cobalt phthalocyanine catalyst impregnated with from about 0.1 to about 25 wt. % naphthalenesulfonic acid, said contacting being at oxidation conditions in the presence of an alkanoltrialkylammonium hydroxide.

A still more specific embodiment concerns a process which comprises contacting said distillate with a charcoal-supported cobalt phthalocyaninemonosulfonate catalyst impregnated with from about 0.1 to about 25 wt. % 2-hydroxy-6-naphthalenesulfonic acid, said contacting being at oxidation conditions in the presence of from about 1 to about 500 ppm ethanoltrimethylammonium hydroxide based on the weight of said distillate.

Other objects and embodiments of this invention will become apparent in the following detailed specification.

Pursuant to the present invention, a mercaptan-containing sour petroleum distillate is treated in contact with a supported mercaptan oxidation catalyst impregnated with a polynuclear aromatic sulfonic acid. The commercially available polynuclear aromatic sulfonic acids, particularly the commercially available naphthalenesulfonic acids, will frequently comprise one or more substituents or functional groups, for example, amino, hydroxyl, carboxyl, and the like, but such substituted polynuclear aromatic sulfonic acids will nevertheless effect an improved activity stability as herein contemplated. Suitable polynuclear aromatic sulfonic acids therefore include not only 1-naphthalenesulfonic acid, 2-naphthalenesulfonic acid, 1,5-naphthalenedisulfonic acid, 1,6-naphthalenedisulfonic acid, 2,7-naphthalenedisulfonic acid, 2-phenanthrenesulfonic acid, 3-phenanthrenesulfonic acid, 9-phenanthrenesulfonic acid, 1-anthracenesulfonic acid, 2-anthracenesulfonic acid, and the like, but also 4-amino-1-naphthalenesulfonic acid, 7-amino-1-naphthalenesulfonic acid, 4-amino-2-naphthalenesulfonic acid, 4-amino-5-naphthalenesulfonic acid, 1-hydroxy-2-naphthalenesulfonic acid, 1-hydroxy-4-naphthalenesulfonic acid, 1-hydroxy-5-naphthalenesulfonic acid, 2-hydroxy-1-naphthalenesulfonic acid, 2-hydroxy-6-naphthalenesulfonic acid, 2-hydroxy-7-naphthalenesulfonic acid, 2-hydroxy-8-naphthalenesulfonic acid, 4-hydroxy-1-naphthalenesulfonic acid, 5-hydroxy-1-naphthalenesulfonic acid, 7-hydroxy-1-naphthalenesulfonic acid, 8-hydroxy-1-naphthalenesulfonic acid, 6-hydroxy-2-naphthalenesulfonic acid, 7-hydroxy-2-naphthalenesulfonic acid, 7-amino-1,3-naphthalenedisulfonic acid, 4-amino-5-hydroxy-2,7-naphthalenedisulfonic acid, 4,5-dihydroxy-2,7-naphthalenedisulfonic acid, 7-hydroxy-1,3-naphthalenedisulfonic acid, 3-hydroxy-2,7-naphthalenedisulfonic acid, 1-hydroxy-3,6-naphthalenedisulfonic acid, 1-hydroxy-4,8-naphthalenedisulfonic acid, 2-hydroxy-3,6-naphthalenedisulfonic acid, 2-hydroxy-6,8-naphthalenedisulfonic acid, 1,3,6-naphthalenetrisulfonic acid, and the like.

The catalyst supports herein contemplated include the various and well-known solid adsorbent materials in general use as a catalyst support. Preferred adsorbent materials include the various charcoals produced by the destructive distillation of wood, peat, lignite, nutshells, bones and other carbonaceous matter, and preferably such charcoals as have been heat treated, or chemically treated, or both, to form a highly porous particle structure of increased adsorbent capacity, and generally defined as activated charcoal. Said adsorbent materials also include the naturally occurring clays and silicates, e.g., diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof, like silica-alumina, silica-zirconia, alumina-zirconia, etc. Any particular solid adsorbent material is selected with regard to its stability under conditions of its intended use. For example, in the treatment of a sour petroleum distillate, the solid adsorbent material should be insoluble in, and otherwise inert to, the aqueous alkaline solution and the petroleum distillate at conditions existing in the treating zone. In the latter case, charcoal and particularly activated charcoal, is preferred because of its capacity for the preferred metal phthalocyanines and because of its stability under treating conditions. However, it should be observed that any of the other well-known solid adsorbent carrier materials, particularly the refractory inorganic oxides, may be employed.

Impregnation of the support with the selected polynuclear aromatic sulfonic acid can be effected in any conventional or otherwise convenient manner. Thus, the support or carrier material in the form of spheres, pills, pellets, granules, or other particles of uniform or irregular shape, is soaked, dipped, suspended or otherwise immersed in a solution of said sulfonic acid. The impregnating solution is suitably an aqueous and/or alcoholic solution, and in some cases, solubility of the sulfonic acid is enhanced by the inclusion of an alkaline material, for example, sodium hydroxide. The polynuclear aromatic sulfonic acid concentration is such as to provide a final catalytic composite from about 0.1 to about 25 wt. % polynuclear aromatic sulfonic acid. The impregnated support may be allowed to dry at room temperature, dried in an oven, or in a flow of hot gases, or in any other suitable manner.

While it is not intended to limit or restrict the present invention by any particular theory, it is contemplated that the improved activity stability exhibited by the catalytic composite of this invention is due at least in part to the polynuclear aromatic sulfonic acid component which occupies sites on the adsorbent support which are susceptible to toxin retention, which sites would otherwise be available during treatment of a sour petroleum distillate and become occupied by toxins having a substantially greater deactivating influence on the catalyst.

The mercaptan oxidation catalyst employed in the practice of this invention can be any of the various catalysts known to the treating art as effective to catalyze the oxidation of mercaptans contained in a sour petroleum distillate with the formation of polysulfide oxidation products. Said catalysts include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g. cobalt tetraphenylporphyrin sulfonate; corrinoid catalysts as described in U.S. Pat. No. 3,252,892, e.g., cobalt corrin sulfonate; chelate organo-metallic catalysts such as described in U.S. Pat. No. 2,918,426, e.g., the condensation product of an aminophenol and a metal of Group VIII; and the like. Metal phthalocyanines are a preferred class of mercaptan oxidation catalysts.

The catalytic composite of this invention may comprise any of the various metal phthalocyanines heretofore disclosed, for example, magnesium, titanium, hafnium, vanadium, tantalum, molybdenum, manganese, iron, cobalt, nickel, platinum, palladium, copper, silver, zinc and tin phthalocyanines, and the like. Cobalt phthalocyanine and vanadium phthalocyanine are particularly preferred metal phthalocyanines. The metal phthalocyanine is preferably employed herein as a derivative thereof, the commercially available sulfonated derivatives, for example, cobalt phthalocyanine monosulfonate, cobalt phthalocyanine disulfonate or mixtures thereof, being particularly preferred. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine or by the action of phosgene and aluminum chloride. In the latter reaction, the acid chloride is formed and may be converted to the desired carboxylated derivative by conventional hydrolysis.

The support can be impregnated with the metal phthalocyanine in any conventional or otherwise convenient manner. In general, the support or carrier material is dipped, soaked, suspended, or otherwise immersed in an aqueous solution and/or dispersion of said metal phthalocyanine, or the aqueous solution and/or dispersion may be sprayed onto, sprayed over, or otherwise contacted with the adsorbent support. In any case, the excess solution and/or dispersion is separated and the resulting composite allowed to dry under ambient temperature conditions, or dried at an elevated temperature in an oven or in a flow of hot gases, or in any other suitable manner.

It is generally preferable to adsorb as much metal phthalocyanine on the adsorbent support as will form a stable catalytic composite—generally up to about 25 wt. %, although a lesser amount in the range of from about 0.1 to about 10 wt. % affords a suitably active catalyst. One suitable and convenient method comprises predisposing the solid support in a distillate treating zone or chamber as a fixed bed, and passing the aqueous metal phthalocyanine dispersion through the bed in order to form the catalyst in situ. This method allows the aqueous dispersion to be recycled one or more times to achieve a desired concentration of the metal phthalocyanine on the adsorbent support. In still another method, the adsorbent support may be predisposed in said treating chamber and the chamber thereafter filled with the aqueous metal phthalocyanine dispersion to soak the support for a predetermined period, thereby forming the catalytic composite in situ.

In the sweetening process herein contemplated, the offensive mercaptans are oxidized to innocuous disulfides in the presence of an alkanolamine hydroxide. The alkanolamine hydroxide is conveniently employed as an aqueous or alcoholic solution thereof—a molar concentration of from about 0.5 to about 5 being suitably effective. It is a preferred practice to prewet the catalyst with the alkanolamine hydroxide prior to contact with the sour petroleum distillate—the alkanolamine hydroxide being subsequently charged to the process in admixture with the sour petroleum distillate charged thereto, continuously or intermittently as required to maintain from about a 1 to about a 500 ppm concentration based on the weight of the sour petroleum distillate. The alkanolamine hydroxides herein contemplated are represented by the structural formula

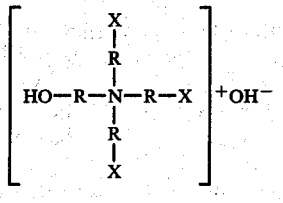

wherein R is an alkylene radical containing up to about 3 carbon atoms, and X is a hydroxyl radical or hydrogen. Suitable alkanolamine hydroxides thus include alkanoltrialkylammonium hydroxides, particularly ethanoltrialkylammonium hydroxides like ethanoltrimethylammonium hydroxide, ethanoltriethylammonium hydroxide and ethanoltripropylammonium hydroxide, but also methanoltrimethylammonium hydroxide, methanoltriethylammonium hydroxide, methanoltripropylammonium hydroxide, propanoltrimethylammonium hydroxide, propanoltriethylammonium hydroxide, propanoltripropylammonium hydroxide, and the like. Other suitable alkanolamine hydroxides include dimethanoldimethylammonium hydroxide, dimethanoldiethylammonium hydroxide, dimethanoldipropylammonium hydroxide, trimethanolmethylammonium hydroxide, trimethanolethylammonium hydroxide, trimethanolpropylammonium hydroxide, diethanoldimethylammonium hydroxide, diethanoldiethylammonium hydroxide, diethanoldipropylammonium hydroxide, triethanolmethylammonium hydroxide, triethanolethylammonium hydroxide, triethanolpropylammonium hydroxide, tetraethanolammonium hydroxide, and the like. Ethanoltrimethylammonium hydroxide (choline) is a preferred alkanolamine hydroxide.

The process of this invention can be effected in accordance with prior art treating conditions. The process is usually effected at ambient temperature conditions, although temperatures up to about 150° C. are suitably employed. Pressures of up to about 1000 psi or more are operable, although atmospheric or substantially atmospheric pressures are entirely suitable. Contact times equivalent to a liquid hourly space velocity of from about 0.5 to about 100 or more are effective to achieve a desired reduction in the mercaptan content of a sour petroleum distillate, an optimum contact time being dependent on the size of the treating zone, the quantity of catalyst contained therein, and the character of the distillate being treated.

As previously stated, sweetening of the sour petroleum distillate is effected by oxidizing the mercaptan content thereof to disulfides. Accordingly, the process is effected in the presence of an oxidizing agent preferably air, although oxygen or other oxygen-containing gas may be employed. The sour petroleum distillate may be passed upwardly or downwardly through the catalyst bed. The sour petroleum distillate may contain sufficient entrained air, but generally added air is admixed with the distillate and charged to the treating zone concurrently therewith. In some cases, it may be of advantage to charge the air separately to the treating zone and countercurrent to the distillate separately charged thereto.

The catalytic composite of this invention is both active and stable. Accordingly, the catalytic composite may be employed in a fixed bed for the treatment of large volumes of sour petroleum distillates. Although the metal phthalocyanine is somewhat soluble in alkaline solution, it is nevertheless retained on the solid adsorbent support. However, in the event that any of the metal phthalocyanine is leached from the support, or otherwise carried away in the alkaline solution, it may be readily recycled in said solution or reused in the sweetening process. However, it is in some cases desirable to introduce additional metal phthalocyanine for adsorption on the solid support in the manner herein described.

The following examples are presented in illustration of certain preferred embodiments of this invention and are not intended as an undue limitation on the generally broad scope of the invention as set out in the appended claims.

EXAMPLE I

This example is presented as a comparative example and is illustrative of prior art treating methods. In this example, a standard or conventional catalyst was prepared by immersing about 120cc of charcoal particles in 300 ml of methanol containing 0.18 gms of cobalt phthalocyanine monosulfonate, and soaking said particles therein for about 24 hours at room temperature. The charcoal employed had a particle size in the 10 × 30 mesh range, and an average bulk density of about 0.41 gms per cc. The charcoal was an activated charcoal commercially available under the Darco trademark. The charcoal thus impregnated was washed with methanol and dried to provide a catalytic composite comprising about 0.6 wt. % cobalt phthalocyanine monosulfonate.

The catalyst of this example was disposed as a fixed bed (100cc) in a vertical tubular reactor. A sour petroleum distillate was charged downflow through the catalyst bed at a liquid hourly space velocity of about 0.5 under 45 psig of air—sufficient to provide about twice the stoichiometric amount of oxygen required to oxidize the mercaptans contained in the distillate. The distillate was a kerosene fraction boiling in the 352°–454° F. range at 742mm. The kerosene fraction contained 448 ppm mercaptan sulfur. In accordance with prior art practice, the catalyst bed was initially wetted with about 10cc of an 8% aqueous sodium hydroxide solution, 10cc of said solution being subsequently charged to the catalyst bed at 12 hour intervals admixed with the kerosene feed stock. The treated kerosene was analyzed periodically for mercaptan sulfur, the mercaptan sulfur content being plotted against the number of hours on stream (broken line) in the attached drawing.

EXAMPLE II

In this example, the charcoal particles were first impregnated with a polynuclear aromatic sulfonic acid in accordance with the present invention. Thus, about 300cc of the charcoal particles were immersed in a near boiling solution of 2-hydroxy-6-naphthalenesulfonic acid (26 gms) and 300 ml of water containing 20 ml of 8% aqueous sodium hydroxide. The resulting solution was cooled and the particles aged therein for about 5 days at room temperature with occasional stirring. The liquid phase was then decanted and the charcoal washed with methanol and dried. About 150cc of the impregnated charcoal was subsequently further impregnated with 0.15 gms of cobalt phthalocyanine monosulfonate. This impregnation was effected by soaking the charcoal for about 24 hours at room temperature in 300 ml of methanol containing 0.15 gms of the cobalt phthalocyanine monosulfonate. The impregnated charcoal was then washed with methanol and dried.

The catalyst of this example was disposed as a fixed bed (100cc) in a vertical tubular reactor. The described sour petroleum distillate was charged downflow through the catalyst bed at a liquid hourly space velocity of about 0.5 under 45 psig of air. In accordance with the process of this invention, the catalyst bed was initially wetted with about 10cc of a 2 molar aqueous ethanoltrimethylammonium hydroxide solution, 10cc of said solution being subsequently charged to the catalyst bed at 12 hour intervals admixed with the kerosene charged thereto. The treated kerosene was analyzed periodically for mercaptan sulfur, the mercaptan sulfur content being plotted against the number of hours on stream (dash-dot line) in the attached drawing.

EXAMPLE III

In illustration of the combined effect of the polynuclear aromatic sulfonic acid-impregnated catalyst and the use of an alkanolamine hydroxide in the treating process, a polynuclear aromatic sulfonic acid-free catalyst, i.e., the catalyst of Example I, was evaluated substantially as described in Example III, i.e., by substituting an aqueous alkanolamine hydroxide solution for the conventional aqueous sodium hydroxide solution. Thus, in this example, the catalyst of Example I was disposed as a fixed bed in a vertical tubular reactor, and the described sour petroleum distillates was charged downflow through the catalyst bed at a liquid hourly space velocity of about 0.5 under 45 psig of air. The catalyst bed was initially wetted with about 10cc of 2 molar aqueous ethanoltrimethylammonium hydroxide solution, 10cc of said solution being subsequently charged to the catalyst bed at 12 hour intervals admixed with the kerosene charged thereto. After 300 hours on stream, the ethanoltrimethylamine hydroxide molar concentration was reduced to 1.3. The treated kerosene was analyzed periodically for mercaptan sulfur, the mercaptan sulfur content being plotted against the number of hours on stream (solid line) in the attached drawing.

I claim as may invention:

1. A process for treating a mercaptan-containing sour petroleum distillate to oxidize the mercaptan present in said distillate, said process comprises contacting said distillate with a supported mercaptan oxidation catalyst impregnated with from about 0.1 to about 25 wt. % polynuclear aromatic sulfonic acid, said contacting being at oxidation conditions with an oxidizing agent and with an alkanolamine hydroxide represented by the structural formula

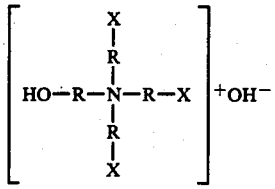

wherein R is an alkylene radical containing up to about 3 carbon atoms, and X is a hydroxyl radical or hydrogen.

2. The process of claim 1 further characterized in that said polynuclear aromatic sulfonic acid is a naphthalene disulfonic acid.

3. The process of claim 1 further characterized in that said polynuclear aromatic sulfonic acid is a naphthalenesulfonic acid.

4. The process of claim 1 further characterized in that said polynuclear aromatic sulfonic acid is an amino substituted polynuclear aromatic sulfonic acid.

5. The process of claim 1 further characterized in that said polynuclear aromatic sulfonic acid is 7-amino-1,3 naphthalenedisulfonic acid.

6. The process of claim 1 further characterized in that said polynuclear aromatic sulfonic acid is a hydroxy-substituted polynuclear aromatic sulfonic acid.

7. The process of claim 1 further characterized in that said polynuclear aromatic sulfonic acid is 2-hydroxy-6-naphthalenesulfonic acid.

8. The process of claim 1 further characterized in that said alkanolamine hydroxide is an alkanoltrialkylammonium hydroxide.

9. The process of claim 1 further characterized in that said alkanolamine hydroxide is an ethanoltrialkylammonium hydroxide.

10. The process of claim 1 further characterized in that said alkanolamine hydroxide is ethanoltrimethylammonium hydroxide.

11. The process of claim 1 further characterized in that said catalyst comprises an activated charcoal impregnated with from about 0.1 to about 10 wt. % cobalt phthalocyanine.

12. The process of claim 1 further characterized in that said catalyst comprises an activated charcoal impregnated with from about 0.1 to about 10 wt. % cobalt phthalocyanine monosulfonate.

13. The process of claim 1 further characterized in that said alkanolamine hydroxide is present in an amount equivalent to from about 1 to about 500 ppm based on the weight of the petroleum distillate.

14. The process of claim 1 further characterized in that said distillate is maintained in contact with said catalysts for a time equivalent to a liquid hourly space velocity from about 0.1 to about 10.

* * * * *